United States Patent [19]

Gartner et al.

[11] Patent Number: 4,899,562

[45] Date of Patent: Feb. 13, 1990

[54] ELECTRONIC DOOR LOCK

[76] Inventors: Klaus W. Gartner, 2632 Via Anacapa, Palos Verdes, Calif. 90274; Alan K. Uyeda, 8317 Elsmore Dr., Rosemead, Calif. 91770

[21] Appl. No.: 193,520

[22] Filed: May 11, 1988

[51] Int. Cl.[4] ..... E05B 47/00

[52] U.S. Cl. ..... 70/277; 70/311; 70/332

[58] Field of Search ..... 70/133, 149, 277, 278, 70/279, 311, 332

[56] References Cited

U.S. PATENT DOCUMENTS

| | | |
|---|---|---|
| 1,353,257 | 9/1920 | Mample . |
| 2,079,702 | 5/1937 | Diesel . |
| 2,775,114 | 12/1956 | Lee . |
| 3,045,466 | 7/1962 | Herlong . |
| 3,339,382 | 9/1967 | Miller et al. . |
| 3,376,721 | 4/1968 | Levine . |
| 3,559,430 | 2/1971 | Waller . |
| 3,702,070 | 11/1972 | Gartner . |
| 3,758,734 | 9/1973 | Gartner . |
| 3,968,667 | 7/1976 | Gartner . |
| 3,980,844 | 9/1976 | Bianco . |
| 4,038,846 | 8/1977 | Klann . |
| 4,106,316 | 8/1978 | Tippin . |
| 4,148,092 | 4/1979 | Martin . |
| 4,328,689 | 5/1982 | Keller et al. . |
| 4,745,784 | 5/1988 | Gartner . |

*Primary Examiner*—Robert L. Wolfe

*Attorney, Agent, or Firm*—Poms, Smith, Lande & Rose

[57] ABSTRACT

An electronic door lock is provided with a single control knob used for entering a predetermined combination through manipulation of the knob in a first arc of rotation, the code being entered by pushing the dial inwardly to bring a push pad into contact with individual ones of an arcuate array of electrical switches provided on a printed circuit board within the lock housing, the release of the door locking bolt being accomplished after entry of the predetermined code by further manipulation of the control knob through remaining portions of knob rotation which are unavailable until after entry of the predetermined code.

9 Claims, 5 Drawing Sheets

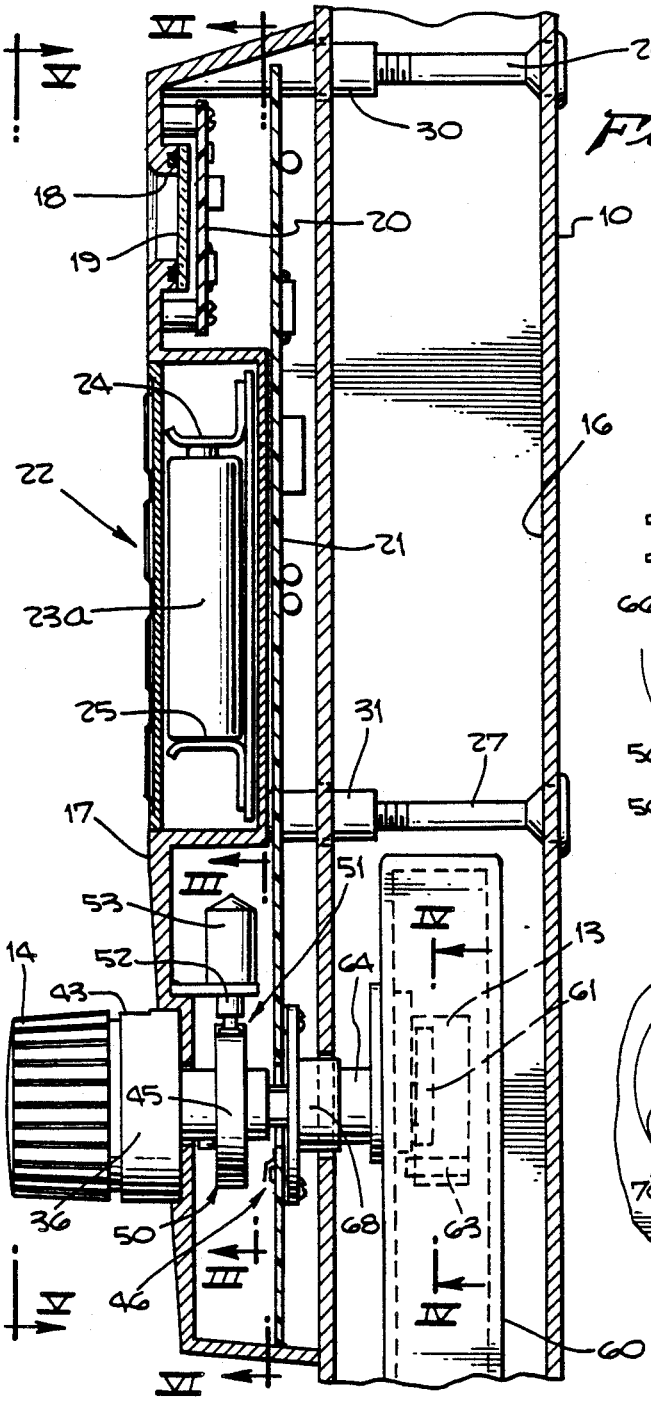
Fig. 2.
Fig. 3.
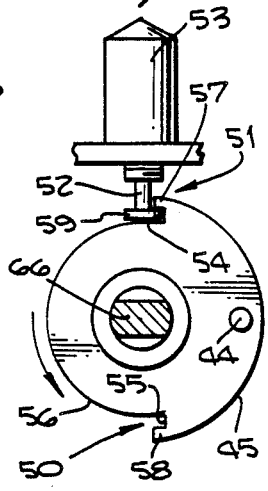
Fig. 4.
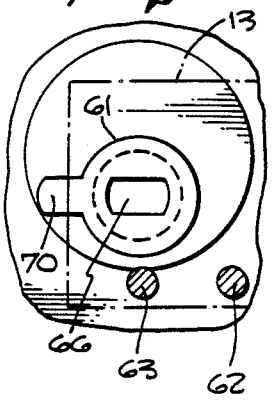

ELECTRONIC DOOR LOCK

BACKGROUND OF THE INVENTION

The present invention relates in general to electronically operated door locks and more specifically to electrical door locks wherein a door opening code is entered through the use of a rotatable and axially moveable control knob for entering a predetermined code by contacting switches provided on a printed circuit board within the lock housing. More specifically, the present invention relates to such locks which are adaptable for replacement of ordinary dead bolt lock mechanisms in association with continued use of the door handle and spring bolt of an otherwise standard door.

Electronic door locks have been developed heretofore which provide for the manipulation of a control knob through two degrees of movement, rotation and axial translation, to select and enter individual ones of a predetermined sequence of a numerical or other bases code in association with a printed circuit board provided within the lock housing. Exemplary thereof is the electronic dial combination lock of prior application Ser. No. 06/854,330 filed Apr. 21, 1986 and now U.S. Pat. No. 4,745,784 by Klaus W. Gartner, the disclosure of which is incorporated herein by this reference. In that lock, dialing of the control knob for selection of a numerical code indicia on the dial face is translated into an electrical contact made on the circuit board within the lock housing by pushing the control knob inwardly of the lock. The circuit board has appropriate circuitry for generation of an electrical signal to an associated solenoid which controls movement of a locking lever which prevents opening of the lock until the combination was entered. The dial is rotated through a full 360° of rotation allowed during entry of the code and is thereafter employed for opening the lock after the predetermined code has been entered. That lock is particularly suitable for replacing a standard gated tumbler wheel type mechanical combination lock with an electrical combination lock as more fully described in said application.

SUMMARY OF THE INVENTION

It would be desirable to be able to modify a standard dead bolt lock mechanism of a typical residential and/or commercial entry door with an electronic lock which would give increase security to such a door. It would also be desirable to be able to continue to use the preexisting dead bolt and the door opening handle normally provided on such doors in association with the standard spring bolt latch normally employed.

It is therefore a primary object of the present invention to provide an electronic lock for a conventional residential or commercial door wherein the lock mechanism is easily assembled to such a door in place of the manipulative portions of the existing dead bolt mechanism. It is also an object of the present invention to provide such a lock wherein a single control knob may be employed for entry of the combination as well as for moving the bolt between protracted and retracted positions. It is still further object of the present invention to provide a lock as in the foregoing objects wherein the movement of the control knob is limited during the code entry mode to a limited amount of rotation wherein it is not capable of moving the door bolt until after the code has been entered, the knob being then freed to be manipulated by the user to throw the bolt between the door locking protracted and door release retracted positions.

Generally stated, the present invention includes the provision of a dial and push electronic door lock having a code entry and door bolt control knob wherein a printed circuit board is provided with a plurality of electrical contact switches disposed in a semi-circular array of 180° arc or less for receiving a predetermined coded sequence of switch actuations and to thereafter generate a code responsive electrical signal, a switch actuating means including a switch engaging push pad mounted eccentrically of a central portion of a dial shaft associated disc, the disc being thereby mounted for both rotational and axial movement in response to similar movement of the control knob, limiting means for normally limiting the arc of rotation of the knob shaft and associated switch actuating means to an arc commensurate with that of the semi-circular array of switches, electrically operated means associated with the printed circuit board for deactivating the limit means on receipt of a code responsive electrical signal sent by the circuit board means and door bolt connecting means for connecting the knob to the door bolt for shifting the latter when the knob limiting means has been released through entry of the predetermined code.

More specifically, the limiting means of the present lock includes the provision of a pair of limit stops on a disc mounting the switch engaging pad which cooperate with a post portion of the armature of an electrically operated solenoid, the post normally be biased to a protracted position where it interferes with the stop means to thereby limit rotation of the knob shaft mounted disc until the electrical solenoid is operated by the associated printed circuit board generated signal to release the disc and associated knob for free rotation. More specifically, the stop means provided on the disc have retainer lips over-hanging associated stop surfaces which extend perpendicularly to the periphery of the disc and the armature post is provided with a flange on the end thereof whereby, when the disc is rotated to the limits of its arcuate rotation allowed by the stops engaging the post, the post retainer flange underlies the stop means retainer lips at either extremity of limited knob rotation to prevent unauthorized lock defeating manipulation of the post relative to the stop means through vibration, pounding or other attempted unauthorized manipulation of the lock parts.

In addition to the foregoing the electronic lock of the present invention has a flat sided axial extension formed integrally of the shaft mounted disc employed as part of the limiting means which is adapted to slip fit into a standard tailpiece normally employed in shifting lock bolts inwardly and outwardly of the lock bolt housing. The lock of the present invention is thereby adapted to mate with and utilize an existing door dead bolt and tailpiece mechanism by being mountable to the front surface of such a door with the extension entering the door through the preexisting dead bolt actuating knob mounting aperture and engaging into such preexisting door latch operating lock tailpiece.

A more complete understanding of the electronic door lock of the present invention will be afforded to those skilled in the art, as well as a realization of additional advantages and objects thereof, by a consideration of the following detailed description of a preferred exemplary embodiment thereof. Reference will be made to the appended sheets of drawings which will be first described briefly.

BRIEF DESCRIPTION OF THE DRAWINGS

FIG. 2 is a section view of the lock of FIG. 1 taken therein along the plane II—II.

FIG. 3 is a detail view taken in the plane of III—III in FIG. 2.

FIG. 4 is a detail view taken in the plane of IV—IV in FIG. 2.

DETAILED DESCRIPTION OF A PREFERRED EXEMPLARY EMBODIMENT

Figure 1:
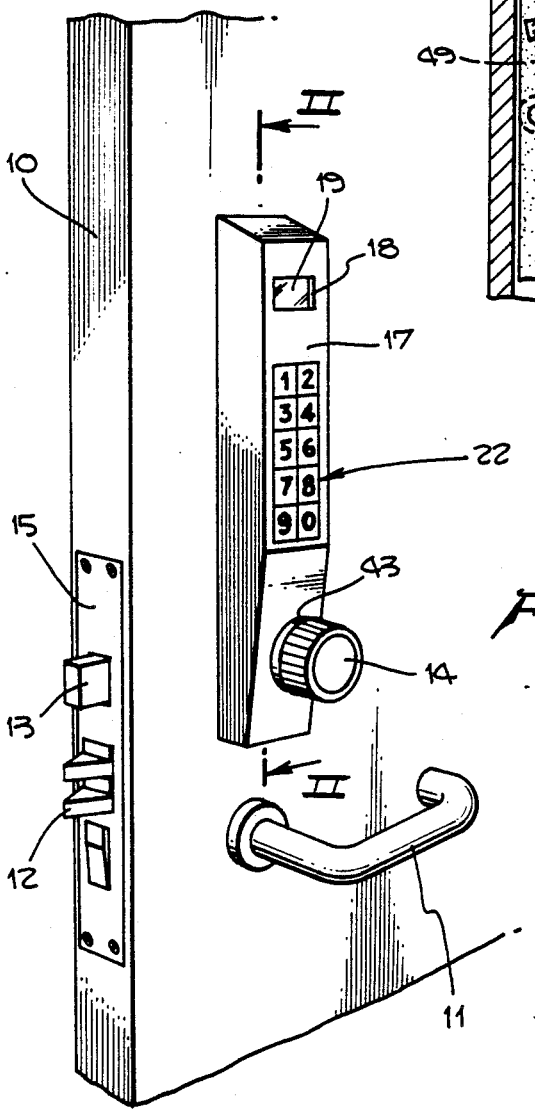
FIG. 1 is a perspective view of an exemplary metal door installation of a preferred exemplary embodiment of the electronic door lock of the present invention.
Figure 5:
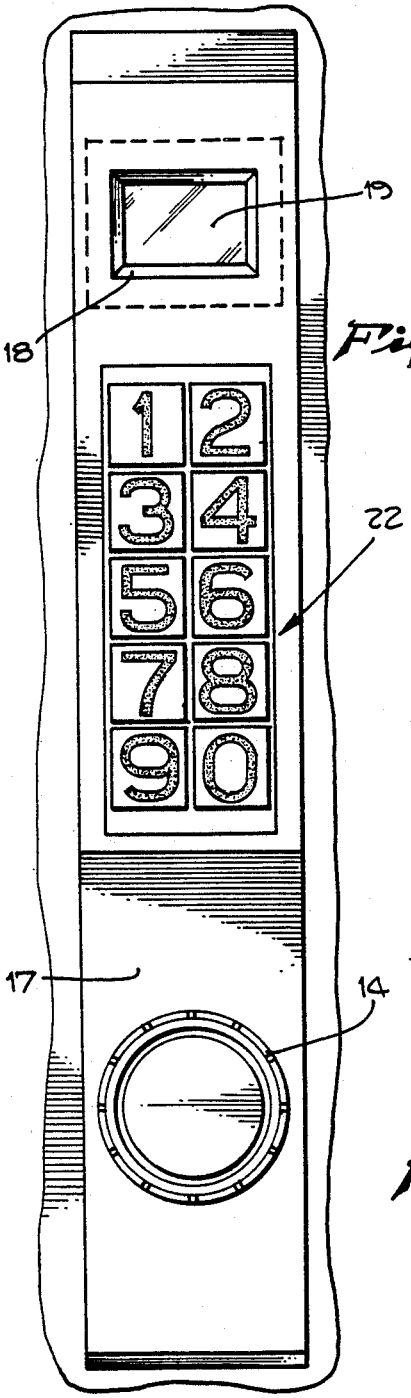
FIG. 5 is a front elevational view of the lock face plate taken in FIG. 2 along the plane V—V.

Referring now to FIG. 1, a preferred exemplary embodiment of an electronic door lock in accordance with the present invention is illustrated in association with a metal door 10 having an otherwise standard door handle 11 which operates a door latch or spring bolt 12. Dead bolt 13 is, in accordance with present invention, controlled by rotation of the control knob 14 which is also used for entering the electronic code as will be described hereinafter. A standard face plate 15 closes the door cavity within which the spring bolt 12 and dead bolt 13 operate as hereinafter described.

As seen in FIG. 2, the electronic door lock components are provided partially within a rear housing 16 formed within metal door 10, and partially within a face plate 17 which forms a front housing with door 10. Face plate 17, as seen in FIGS. 1 and 2, is provided with a viewing aperture 18, having a transparent window 19 in front of a liquid crystal display 20. The liquid crystal display 20 is electrically connected to a printed circuit board 21 such that code numbers selected, through manipulation of control knob 14 as hereinafter described, will be displayed on the liquid crystal display 20 and viewable through viewing aperture 18. An alternative manner of entering the code for the electronic lock of the present invention is provided through the digital input pads illustrated generally at 22 on the front face of face plate 17 as seen in FIGS. 1 and 2. A self contained power source for the printed circuit board 21 is provided via the batteries **23*a* and 23*b* which is mounted by spring electrical connectors 24 and 25 within the face plate 17, as best seen in FIGS. 2 and 6**.

Figure 6:
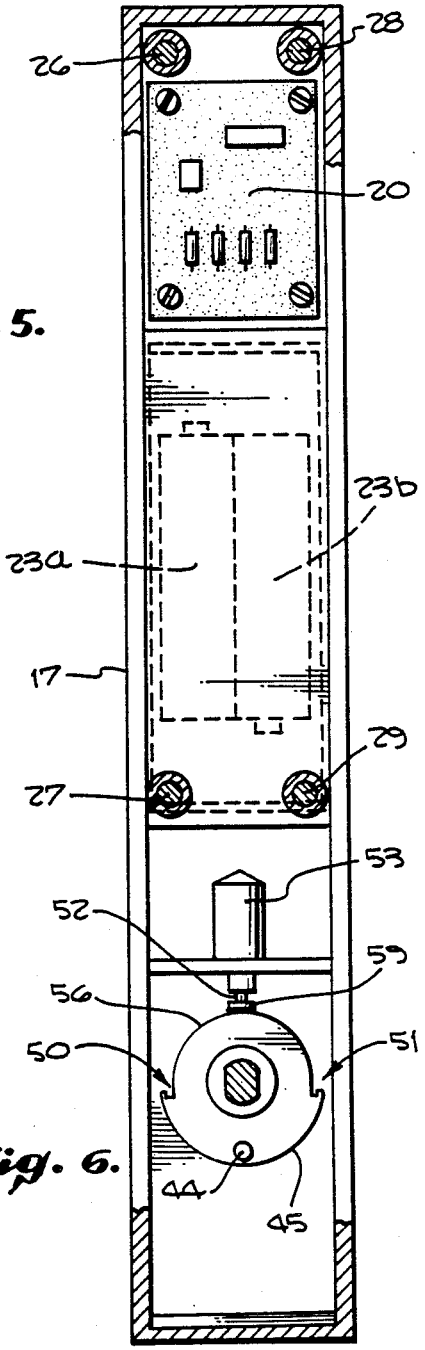
FIG. 6 is a section view through the lock of FIG. 2 taken therein along the plane VI—VI.

As seen with reference to FIGS. 2 and 6, the face plate 17 is mounted securely to the front surface of door 10 via the plurality of mounting bolts 26, 27, 28 and 29 which extend forwardly from a rearward surface of door 10 through the rear housing 16 and into appropriately provided, bored and internally threaded bosses provided in the face plate, as bosses 30 and 31 as seen in FIG. 2.

Figure 7:
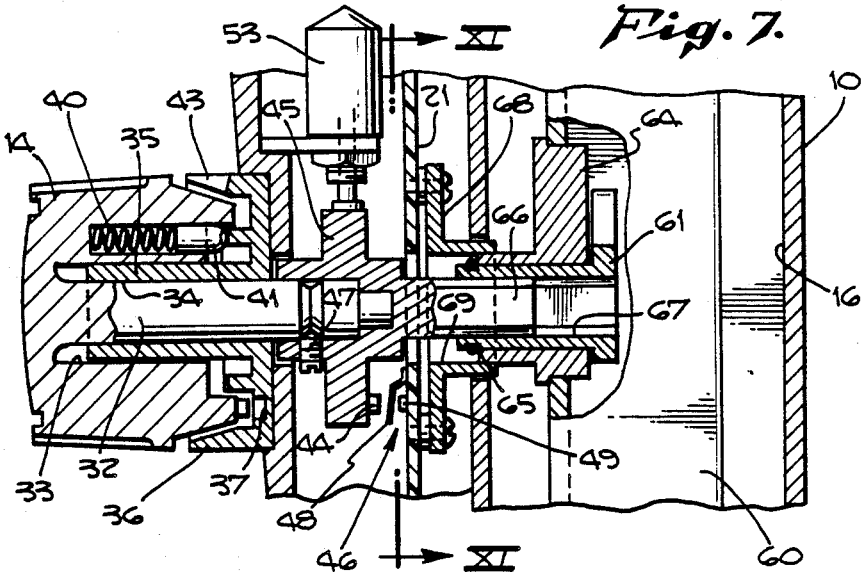
FIG. 7 is a detail view of a portion of the lock of FIG. 2, partially in section showing the control knob in an extended position.
Figure 8:
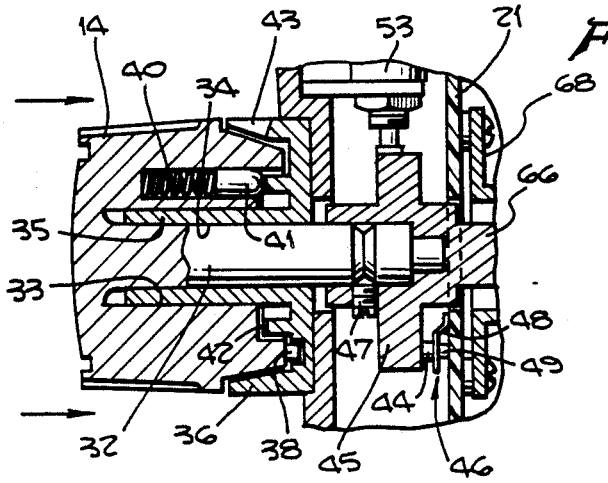
FIG. 8 is a view as in FIG. 7 showing the control knob in a side entry position.
Figure 12:
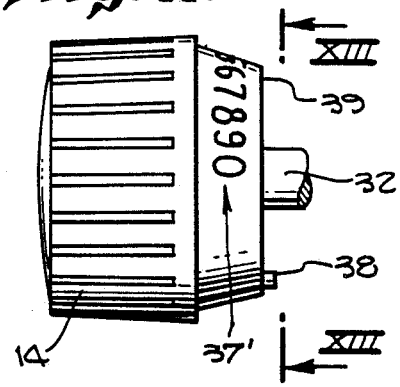
FIG. 12 is a detail view of the control knob of the lock of FIGS. 1 and 2.
Figure 13:
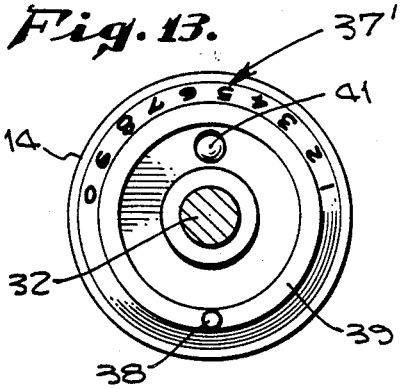
FIG. 13 is a rear elevational view of the knob of FIG. 12 taken therein along the plane XIII—XIII.
Figure 14:
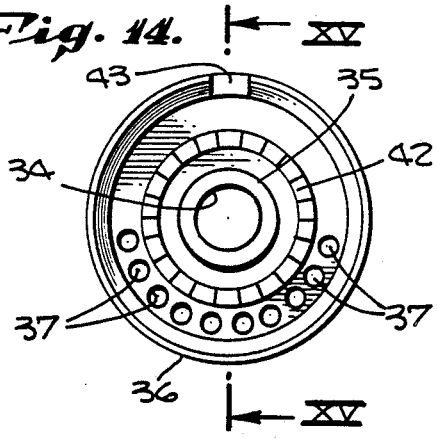
FIG. 14 is a front elevational view of a control knob positioning member associated with the control knob of FIGS. 1, 2, 7 and 8.
Figure 15:
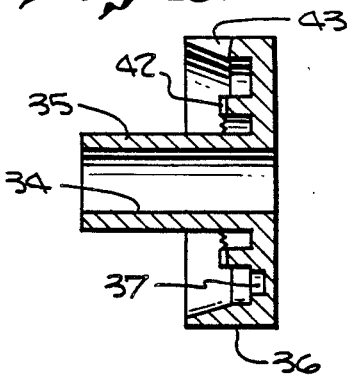
FIG. 15 is a section view of the control knob positioning member of FIG. 14 taken therein along the plane XV—XV.

Referring now to FIGS. 7 and 8, in addition to FIG. 2, the control knob 14 of the electronic door lock of the present invention is provided with a center shaft 32 which extends within a knob bore 33 so as to fit within the bore 34 of a cylindrical portion 35 of knob positioning member 36. The knob positioning member 36, as best seen in FIGS. 14 and 15, is provided with a plurality of positioning apertures 37 which are adapted to receive a locating pin 38 which is, as best seen in FIGS. 12 and 13, provided on an inwardly directed surface 39 of knob 14. Knob 14 is normally biased in an outward direction, relative the positioning member 36, by spring means, as spring 40, which bears against a slide pin 41 which in turn abuts a ratcheting surface 42 on positioning member 36. Inward manipulation of the knob 14 is located into any one of 10 locating apertures, said apertures 37 being provided in an approximate 180° array as seen in FIG. 14. Rotation of knob 14 thus tends to be incrementally advanced as spring biased pin 41 ratchets over the ratcheting surface 42 and the chosen location for knob 14, when it is depressed inwardly by the operator, is directed precisely into only one of ten possible locations through the cooperation of knob locating pin 38 and the apertures 37 as discussed. As is also seen in FIGS. 12 and 13, knob 14 is provided with numerical indicia, indicated generally at 37' which can correspond with a visually perceivable index position provided on member 36 and which individually correspond to the individual ten locations provided by the apertures 37.

Figure 11:
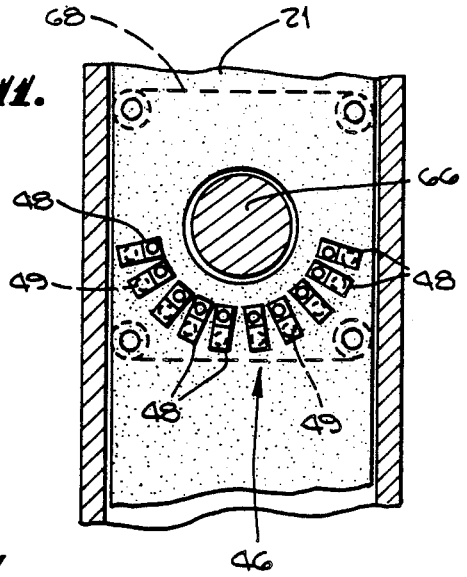
FIG. 11 is a front view of the circuit board of the lock taken in the plane XI—XI in FIG. 7.

When knob 14 has been located by aligning the numerical indicia, indicated generally at, 37', with a reference point as may be provided at window 43 in member 36, an inward manipulation of knob 14, as seen in FIG. 8, brings a push pad 44 mounted eccentrically upon disc 45 into engagement with one of the printed circuit board switches, such as the switch indicated generally at 46 in FIGS. 7, 8 and 11. Disc 45 is held to shaft 32 by a set screw 47 and is thereby adapted to rotate along with rotation of shaft 32 via manipulation of knob 14 in a rotative direction.

As is particularly contemplated within the present invention, switch 46 of FIGS. 7 and 8 is one of a plurality of such switches arranged in an approximate 180° orbital array as best seen in FIG. 11. While these switches could comprise thin or thick film touch pads of a type generally known in the art, it is preferred in the present exemplary embodiment that they comprise mechanical switches including a moveable spring arm contact positioned over a stationary contact, both on the printed circuit board, as in the case of spring clip 48 and stationary contact 49 in FIGS. 7 and 8. Each of the thus provided switches, such as the switch indicated at 46, provide a distinct, pressure-sensitive switch for completing an electrical circuit provided in known manner on the printed circuit board 21. Board 21 includes circuit means for sensing the making of the electrical connections by the switches, as switch 46, and detecting when a given subset of connections has been made in a predetermined, sequential order corresponding to a code or combination for the lock. The circuit board also has means for generating an electrical signal, such as a voltage, to operate a lock release means as discussed hereinafter.

As is also particularly contemplated within the present invention, the signal generated by the printed circuit of board 21 as previously discussed is utilized in the present lock for operating a knob rotation limiting means to a release position so that the knob can be employed for opening the lock in addition to the entry of the predetermined code. As explained hereinabove, the knob has a push pad 44 which is oriented by rotation of the knob relative to the knob location means 36 to select any one of the plurality, 10 in the exemplary embodiment, switches on the circuit board 21 which are arranged in a 180° arcuate array. As is particularly contemplated within the present invention, rotation of the knob through the other 180° of arcuate rotation for the knob throws the bolt 13 to allow opening of the door 10. However, limiting means are provided for preventing rotation of knob 14 through this other 180° of rotation until after the predetermined code has been entered through rotation of the knob in the first 180° of rotation relative to the circuit board switches.

Figure 9:
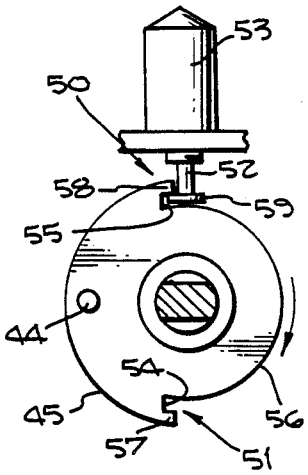
FIG. 9 is a detail view as in FIG. 3 showing the associated knob rotation limiting disc in a position 180° off of that shown in FIG. 3.

In the preferred exemplary embodiment, the limiting means for limiting code entering rotation of knob 14 to a first 180° arc of rotation includes the provision of a pair of limit stops, indicated generally at 50 and 51 respectively, as seen in FIGS. 3, 6 and 9. Such limit stops are formed integrally of the disc 45 fixed upon dial shaft 32 as previously described. In addition, the exemplary limiting means includes the provision of post 52, which in the exemplary embodiment comprises a portion of the armature of an electrically operable solenoid 53, the post 52 being normally positioned as seen in FIGS. 3 and 9 to be abutted by the limit stops, indicated generally 50 and 51, to limit rotation of the dial shaft 32, and thus dial 14 to a first 180° arc of rotation. The push pad 44 is seen in FIGS. 3 and 9 thus is also provided with a maximum 180° arc of rotation which corresponds to the arc of the array of switches, as switch 46, provided on the circuit board 21 as seen in FIG. 11. Solenoid 53 is electrically connected to a printed circuit of board 21 in otherwise known manner so as to receive the electrical signal, such as voltage, generated by the circuit board 21 when a predetermined, sequential order of switch contacts are made by the manipulation of dial 14 and its associated push pad 44 to enter a predetermined code. As is also known in the art, the circuit of the board 21 may include a timing means for holding the solenoid 53 in an electrically operable mode for a period of time so that manipulation of the lock can be accomplished while the solenoid is activated.

Figure 16:
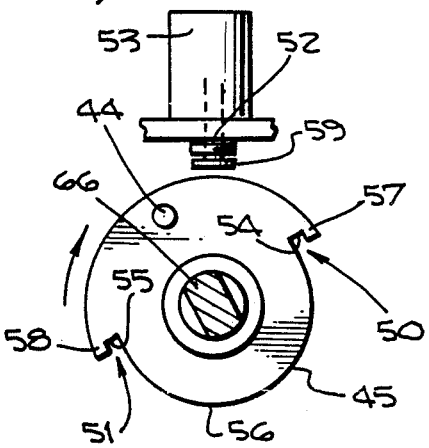
FIG. 16 is a view as in FIGS. 3 and 9 showing the control knob limiting means in a knob release condition.

In the exemplary embodiment, when solenoid 53 is electrically operated through entry of a predetermined code as discussed above, the post 52 is withdrawn inwardly of the solenoid as shown in FIG. 16. Disc 45 is thereby released from its limited rotation and manipulation of knob 14 through the remaining 180° of arcuate rotation available, as described hereinafter, throws bolt 13 to a door release position.

The preferred exemplary embodiment limit stops, indicated generally at 50 and 51 in accordance with the present invention, comprise more specifically the provision of a pair of stop surfaces 54, 55 respectively as seen in FIG. 16, at the opposite ends of peripheral surface 56 on disc 45. Importantly, the stop surfaces 54 and 55 are provided with over-hanging retainer lips 57, 58 which cooperate with the retainer flange 59 to retain post 52 in its knob rotation limiting positions of FIGS. 3 and 9, the flange 59 underlying the associated retainer lip of the stop surfaces when the knob is turned to the limits of the 180° arc of rotation provided. The provision of the retainer lips described is important to prevent unauthorized rotation of knob 14 in the bolt unlocking mode as might otherwise occur if the post 52 could be urged inwardly of solenoid 53, against the outward bias of an internal spring provided, through vibration, tapping or other unauthorized manipulation of the lock mechanism when the post 52 is adjacent either of the stop surfaces. The provision of the retainer flange on post 52 and retainer lips 57 and 58 hold post 52 in engagement with the limit stops 50 and 51 in a secure non-defeatable manner when the knob 14 has been rotated to either extremes of its limited arc of rotation.

Considering now the manner of manipulation of bolt 13 through operation of control knob 14 and referring initially to FIG. 2, the bolt 13 is provided in known manner in a bolt housing 60 within the surrounding housing 16 provided by door 10. As will be subsequently explained, bolt 13 is moved from its door locking extended position of FIG. 4 to a retracted door release position as shown in an interim transition position in FIG. 17 through the manipulation of tail piece 61 relative to a pair of spaced pins 62 and 63 protruding laterally of a sidewall of bolt 13 within the bolt housing 60. As best seen in FIG. 7, tail piece 61 is rotatively mounted in bushing 64 mounted in an apertured sidewall of bolt housing 60 and is retained relative thereto by O-ring 65. A flat sided axial extension member 66 formed integrally of disc 45 is slip fit into a substantially rectangular bore 67 of tailpiece 60 to facilitate rotation of tailpiece 61 within its bushing 64 in direct response to rotation of shaft 32 by control knob 14. As is also seen in FIG. 7, a mounting flange 68 is provided to rest within a mating aperture in the front wall of door 10 to provide a mounting for circuit board 21 with a central bore 69 being provided to accommodate passage of extension 66 through the door into rear housing 16 and into engagement with tailpiece 61 as seen in FIG. 7.

Figure 10:
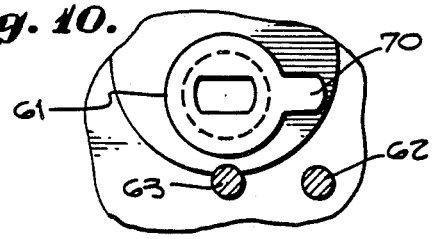
FIG. 10 is a view as in FIG. 4 showing the knob shaft associated tailpiece tip oriented in a direction 180° off of that shown in FIG. 4.
Figure 17:
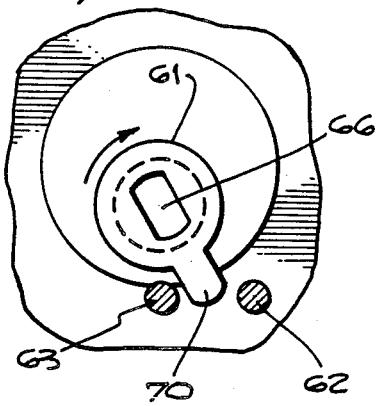
FIG. 17 is a view as in FIGS. 4 and 10 showing the knob shaft associated tailpiece engaging a rearward pin on the associated bolt to throw the bolt to an unlocking position.

Manipulation of knob 14 during the code entry mode wherein knob rotation is limited to a first 180° arc of rotation for shaft 32 is seen by a comparison of FIGS. 4 and 10 wherein tailpiece 61 has been rotated from one extreme in FIG. 4 to the other extreme in FIG. 10 allowed by the limit stops 50 and 51. However, upon entry of a predetermined code, and the energization of solenoid 53 to retract post 52 as seen in FIG. 16, the control knob shaft 32 is released for rotation through the other 180° arc of rotation as discussed hereinabove. Such rotation of knob 14 in a counterclockwise direction in FIG. 1 produces a clockwise rotation of tailpiece 61 when viewed in FIGS. 4, 10 and 17 bringing the tailpiece tip 70 into engagement with rear pin 63, as seen in FIG. 17 to throw bolt 13 to a retracted door opening position. Subsequently, when knob 14 is rotated in a clockwise direction in FIG. 1, which produces a counterclockwise rotation of tailpiece 61 when viewed in FIGS. 4, 10 and 16 (since they are a rear view of the components illustrated) the tailpiece tip 70 engages the forward pin 2 to throw the bolt back to the protruding, door locking position of FIGS. 4 and 10.

Having thus described a preferred exemplary embodiment of an electronic door lock in accordance with the present invention, it should now be apparent to those skilled in the art that the aforestated objects and advantages for the within lock have been achieved. The control knob 14 may be manipulated through a first 180° arc of rotation, or similar limited arc of rotation which is less than the entire 360° arc available, to allow selection of code indicia through the window 43 and the entry of individual code signals by pressing control knob 14 inwardly for each selected one of such indicia. After entry of the predetermined code, a circuit of board 21 operates the solenoid 53 to a non-limiting position to allow rotation of knob 14 through the remaining portions of the available arc of rotation for the knob, such further rotation of knob 14 throwing bolt 13 to a door release position as discussed hereinbefore. The code may be alternatively entered through the use of the push pads, indicated generally at 22, with the knob thereby being freed from its limited rotation to again throw bolt 13 to a released position and thereafter back to a door locking position. The dial and dial shaft may therefore, in accordance with the present invention, be adapted to operate a door bolt by manipulation of the bolt associated tailpiece only after entry of the electronic lock code.

Having thus described a preferred exemplary embodiment of the present invention, it should be appreciated by those skilled in the art that various modifications, adaptions and alternative embodiments thereof may be made within the scope and spirit of the present invention which is defined by the following claims.

We claim:

1. A dial and push electronic door lock having a code entry and door bolt control knob comprising:

circuit board means with a plurality of electrical contact switches disposed in a semi-circular array for receiving a predetermined coded sequence of switch actuation and to produce a code responsive electrical signal;

switch actuating means including a switch engaging pad mounted eccentrically of a center portion thereof;

mounting means for mounting said switch actuating means for rotative and axial movement of said center portion;

a knob connected to said switch actuating means for manually rotating said pad relative said array of switches and for manually pushing said pad against a selected one of said switches;

limit means for normally limiting the arc of rotation of said switch actuating means to an arcuate rotation of only the extent of said array of switches;

electrically operated means associated with said circuit board means for deactivating said limit means on receipt of a code responsive electrical signal sent by said circuit board means;

door bolt connecting means for connecting said knob to said door bolt for shifting said door bolt between protracted and retracted positions relative said door in response to manipulation of said knob through an arc of rotation which is arcuately displaced from that provided for operating said switches.

2. The dial and push electronic door lock of claim 1 wherein:

said semi-circular array of switches occupies an arc of approximately a first 180° of the circle of rotation of said knob; and said arc of rotation of said knob for shifting said door bolt occupies the remaining 180° of knob rotation available.

3. The dial and push electronic door lock of claim wherein:

said limit means comprises a disc having a pair of limit stops on the periphery thereof and a post normally positioned to engage said stops upon rotation of said disc in either of two rotative directions to thereby limit the arc of rotation of said disc to an arc of less than 360°.

4. The dial and push electronic door lock of claim 3 wherein:

said electrically operated means comprises a solenoid having a body and an armature portion which provides said post.

5. The dial and push electronic door lock of claim 4 wherein:

said disc has retainer lips associated with said stops, and said post has a retainer flange whereby when said post engages one of said stops, said post flange is retained by an associated retainer lip of said lips against said stop.

6. In an electronic door lock having a door locking bolt mechanism, a printed circuit board with pressure sensitive switches in a circuit for producing an electrical signal when a code of predetermined sequence of switch actuations are accomplished and a control knob having a push pad associated therewith to actuate selected ones of said switches by manipulation of said knob, the improvement comprising the provision of:

limit means for normally limiting the rotation of said knob to a limited arcuate extent of rotation less than a full revolution thereof;

means for mounting said switches in an arcuate array coextensive with the arcuate extent of rotation allowed said knob by said limit means;

electrically operated means responsive to said electrical signal generated by said circuit board upon entry of said code for deactivating said limit means whereby said knob is free to rotate beyond said arcuate extent of rotation; and connecting means for connecting said knob to said door locking bolt mechanism and for moving an associated bolt to a door unlocking position upon rotation of said knob beyond said limited arcuate extent.

7. The electronic door lock of claim 6 wherein:

said limit means include a generally circular disc fixed to a shaft connected to said knob, said disc being provided with a pair of opposed stop surfaces spaced about and extending outwardly of a peripheral position of said disc lying therebetween.

8. The electronic door lock of claim 7 wherein:

said electrically operated means includes a solenoid having a body mounted to an interior portion of said lock and an armature having a post portion normally biased outwardly of said body; and said limit means further includes said armature post portion being normally positioned to be abutted by said stop surfaces when said post portion is in its normally biased outwardly of said body position.

9. The electronic door lock of claim 6 wherein said door locking bolt mechanism includes a tailpiece adapted to engage and move the associated bolt of said mechanism on rotation of said tailpiece; and said connecting means includes an extension of said knob shaft which interconnects with said tailpiece, said tailpiece, extension and knob being connected such that said bolt can be manipulated only when said knob is rotated in an arc of knob rotation outside of said limited arcuate extent of rotation afforded said knob by said limit means for entry of said code.

* * * * *